United States Patent [19]

Carlsson et al.

[11] Patent Number: 4,765,246

[45] Date of Patent: Aug. 23, 1988

[54] DETONATOR AND A CHARGE ADAPTED THERETO

[75] Inventors: Staffan Carlsson; Torsten Persson, both of Karlskoga; Bert Jonsson, Nora; Tore Boberg, Karlskoga, all of Sweden

[73] Assignee: Nobel Kemi, Karlskoga, Sweden

[21] Appl. No.: 52,338

[22] Filed: May 21, 1987

[51] Int. Cl.[4] ..... F42B 3/10; C06C 5/06

[52] U.S. Cl. ..... 102/318; 102/275.12; 102/322

[58] Field of Search ..... 102/275.2–275.7, 102/275.9, 275.12, 318, 320, 322, 331, 313

[56] References Cited

U.S. PATENT DOCUMENTS

| | | | |
|---|---|---|---|
| Re. 31,953 | 7/1985 | Calder et al. | 102/318 X |
| 3,431,851 | 3/1969 | Kern et al. | 102/318 |
| 3,971,319 | 7/1976 | Larson | 102/204 |
| 4,060,033 | 11/1977 | Postupack et al. | 102/275.12 |
| 4,060,034 | 11/1977 | Bowman et al. | 102/275.5 |
| 4,165,691 | 8/1979 | Bowman et al. | 102/275.9 X |
| 4,167,139 | 9/1979 | Gleason et al. | 102/313 |
| 4,178,852 | 12/1979 | Smith et al. | 102/322 |
| 4,295,424 | 10/1981 | Smith et al. | 102/320 X |
| 4,324,183 | 4/1982 | Prahauser et al. | 102/275.3 X |
| 4,527,482 | 7/1985 | Hynes | 102/275.7 X |
| 4,637,312 | 1/1987 | Adams et al. | 102/275.12 |

FOREIGN PATENT DOCUMENTS 0164941 12/1985 European Pat. Off. .

*Primary Examiner*—David H. Brown

*Attorney, Agent, or Firm*—Pollock, Vande Sande & Priddy

[57] ABSTRACT

A detonator for non-electric detonation systems for blasting charges intended to be initiated by a detonating fuse includes a passage provided in the body of the detonator for passing a detonating fuse through the passage. The detonator includes a conventional percussion cap which is immediately initiated by the detonating fuse for initiating the detonator. Also a booster charge intended for the detonator is provided with a reinforced central channel for the detonating fuse.

6 Claims, 2 Drawing Sheets

DETONATOR AND A CHARGE ADAPTED THERETO

BACKGROUND OF THE INVENTION

The present invention relates to a detonator for a nonelectric detonation system for blasting charges, primarily intended for interval delay blasting, but also usable in the initiation of individual charges. The present invention also relates to a specially designed booster charge adapted to the detonator.

In delay interval blasting above ground, non-electric detonation systems are generally preferred, since otherwise extreme vigilance must be maintained against the risk of electric storms and the use of radio transmitters in the immediate vicinity. This latter means of communication may constitute a particular problem, since today's contracting and mining industries are making increasing use of communication by radio for work supervision. The use of electric drills and loading machines has also increased considerably, particularly in tunelling work.

PETN fuzes or other detonator fuzes may advantageously be used for a more or less instantaneous initiation of a plurality of blasting charges. It is also possible to initiate the different charges in a delay interval blasting operation by means of a detonating fuze, but in such cases special individually delayed detonators are required which transmit the detonation impulse from the detonating fuze to each respective major charge or booster. A number of different but closely related time delay fuzes of this type and booster charges adapted thereto are disclosed in U.S. Pat. Nos. 4,060,033 and 4,165,691, and also in laid-open EPO Application No. 0,164,941. According to the two U.S. patents, the booster charges are constructed in mutually reminiscent manners, with an insulated tunnel along their one longitudinal edge in which a PETN fuze may pass. Furthermore, the charges are provided with a bore or a groove close to their second longitudinal edge in which the detonation cap of the fuze with its associated delay assembly may be placed. Furthermore, the fuzes described in each respective patent specification are designed with communication means angled from each respective detonation cap and extending across the charges and up to the tunnel for the PETN fuze where they are provided with a pyro assembly. Thus, the intention is that the pyro assembly be initiated when the PETN fuze detonates. The fire from the pyro assembly is then led, through the intermediary of the communication means (which, according to U.S. Pat. No. 4,060,033, is to consist of a low-strength detonating fuze, and, according to U.S. Pat. No. 4,165,691, of an empty, angled plastic tube) further to the delay assembly of the blasting cap in order, to initiate the blasting after the pre-determined time delay cap and, in its turn, each respective booster charge.

Albeit the basic principles of these two charges with their associated detonators may be satisfactory, their detailed designs are nevertheless afflicted with a number of serious drawbacks. Thus, the detonators are designed as elongate, angled members which are sensitive to disruption and may be difficult to mount them in place if the blasting operation is to be carried out during the winter and the charge layer is obliged to work with gloves. Moreover, the insulated tunnels for the PETN fuze are disposed along one longitudinal edge of the booster charges, with the result that the PETN fuze cannot be used for lowering the charges down into narrow bores, which would otherwise have been the most practical solution. The reason for this is that with the lowering cable, for example in this case the PETN fuze, disposed along the one edge of the charge, the "jammed drawer" effect is almost unavoidable betwen the relatively heavy charges and the drill riflings on the side walls of a narrow bore hole.

The booster charge and detonator according to EPO Patent application No. 0,164,941 have more practicable construciton, but neither can these be considered as fully satisfactory from all aspects. Thus, the booster charge consists of an explosive charge encapsulated in a cylindrical casing and provided with a first centered axial through-passage and a second passage disposed parallel with at some distance from the first passage, the second passage being, however, not necessarily a through-passage. According to the EPO application, a low-strength denotating fuze is led through the first passage and a blasting cap with built-in delay assembly is disposed in the second passage. As a communication link between the detonating fuze and the blasting cap there is further provided, in a specially adapted space in one end of the booster charge, a device which in the specification of this application is designated as a coupling charge. The consists of an impact or shock-sensitive detonating explosive encapsulated in its own protective capsule. To hold together the blasting cap, which at its one end face the coupling charge is provided with a percussion cap, and the coupling charge, a separate coupling block is employed. The coupling block is further provided with a slit tubular anchorage member which is intended to be passed down into the first passage for fixedly retaining the interconnected unit consisting of the blasting cap and the coupling charge. In its turn, the anchorage device is provided with a central channel with room for accomodating the detonating fuze.

Thus, the apparatus disclosed in the EPO application offers a booster charge which is initiated by means of a centrally and axially placed detonating fuze through the intermediary of a specially designed and adapted detonator consisting of a separate coupling charge and a blasting cap united by means of a separate coupling block. The disadvantages inherent in this prior art apparatus are that it contains a plurality of different features which must be interconnected and, as a result will be most circumstantial to handle. At the same time, the separate provision of a coupling charge which is initiated by the detonating fuze and in its turn initiates the blasting cap entails the introduction of an extra detonation signal transfer stage which in itself involves increased risk of malfunction. In this context, it cannot be over-emphasized that booster charges of this type are normally employed for the initiation of such low energy explosives as are used in interval or deck blasting in open cast mining and quarrying and in contracting work in which every salvo contains immense amounts of explosives, for which reason any malfunction of the detonation system is wholly unacceptable. The major advantage offered by the detonation system according to the EPO application is probably that the component parts and details are—as is also pointed out in the specification itself—extremely well suited for mass production in modern automatic machines. In all probability, the coupling charge also requires extremely careful handling.

SUMMARY OF THE PRESENT INVENTION

The primary object of the present invention is to provide a detonator produced in a single unit and intended for booster charges of the main type described in the above-mentioned EPO patent application.

The detonator according to the present invention enjoys the advantage that it is supplied ready-for-use as a unit which need not be assembled in conjunction with the charge. As a result, the detonator may easily be handled, even by someone wearing gloves. The sole measure required on final disposition and arrangement of the charge is to insert the detonator into the space intended therefore in the booster charge and to insert a detonating fuze through a passage provided in the detonator body and further through the central channel or tunnel of the coincident booster charge.

A major characteristic feature of the detonator according to the present invention is that the detonating fuze passing through a special passage through the body of the detonator will, on its detonation, directly initiate a percussion cap which is disposed in the immediate vicinity of the passage and is provided with a conventional receptive base, the direction of detonation and effect of the percussion cap being at right angles to the longitudinal direction of the detonating fuze. In its turn, this percussion cap initiates a detonation tablet or capsule which, either directly or through the intermediary of a conventional delay assembly, initiates the blasting cap which detonates the booster charge.

It has become possible to construct a compact, operationally reliable detonator integrated in a single functional unit by disposing the percussion cap in direct association with the detonating fuze, possibly separated from the fuze by a thin metal seal, and with the effective direction of the percussion cap aimed along a first passage disposed at right angles to the fuze, this passage being angled, at a suitable distance, down into a second passage which is parallel with the fuze and terminates with a conventional blasting cap which may be provided with a built-in delay assembly, and finally by disposing the detonating tablet or capsule in the angle between the first and the second passages.

The body of the detonator may be manufactured of metal or plastic, but is suitably of metal.

Percussion caps provided with a receptive base have been used for many years and are extremely reliable in their function. The ignition capsule is highly sensitive to initiation and is suitably mounted in the angle between the first and the second detonation passage immediately above the change of direction where the second ignition passage is angled down in parallel with the longitudinal axis of the booster charge. This entails that the effective direction of the detonation capsule will be aimed straight at the blasting cap. At the same time, this disposition entails that the initiation capsule lies close to the percussion cap, but well protected so as not to be fractured on initiation of the blasting cap. This arrangement ensures an extremely high degree of blasting safety and reliability, at the same time as the percussion cap is disposed in a well protected position within the wall of the passage of the detonating fuze where it may, moreover, be further protected by a thin metal seal. Hence, all high-shatter or "brisant" details are well encapsulated with the detonator body.

As far as the booster charge proper is concerned, the present invention includes calls for the provision of the booster charge with a defining lining about the central passage which protects the secondary explosives in the booster charge from the detonation of the detonation fuze. This provision according to the present invention is intended to enable the employment of standard quality PETN fuzes, thereby obviating the requirement of selecting low-power fuzes of special qualities. Suitably, this lining consists of a thin-walled metal sheath and, preferably, a steel tube which, moveover, may be provided with extra insulation between itself and the explosive, this extra insulation consisting of an elastically or plastically deformable plastic layer. This latter reinforced lining of the central passage may be motivated in, for example, underwater blasting, in which the presence of water in the central passage would markedly increase the pressure rises in the central passage when the detonation fuze is fired.

It is further proposed according to the present invention that one or more ventilation apertures be disposed between the detonator body and the adjacent end of the central passage, such that the gases generated from the detonation of the fuze may be led off from the central passage without the risk that these dislodge the detonator body from its normal position. Such ventilation is most simply provided in that the detonator body be allowed to rest against the edge about the central passage through the intermediary of two or more beads with interjacent openings disposed in the detonator body or the booster.

The present invention also provides a method of anchoring the fuze in the booster, according to which the coring-out or end recess adapted for the detonator body is designed with an edge or ridge projecting at least partly over the assembly mounting position of the detonator body and preventing the detonator from being inserted in place with the blasting cap in its intended passage as long as the passage of the detonator body and the central passage of the booster charge for the detonator fuze are centered in register with one another. Nevertheless, this edge or ridge is of such dimensions as to permit insertion of the fuze down with the blasting cap in the passage intended therefor as soon as the detonator body has been twisted aside such that the aperture and passage do not cover one another, and the detonator body may be twisted into place beneath the ridge as soon as the blasting cap is wholly inserted in the passage intended therefor. In this latter position, the detonator is held in place by the ridge. It is also possible to design the recess in the end of the booster with two opposing beads between which the detonator body is urged into place and snapped in position.

The booster charge is most simply fixed in position on the detonator fuze by an edge beneath the booster and, if required, the end of the booster provided with the detonator may be turned to face downwardly. The detonator will then be reliably fixed in place by the weight of the booster until such time as the detonator fuze is fired.

If extremely high detonation reliability is required, the detonator according to the present invention may be provided with two or more separate, identical detonating units joined together in a single detonator.

The nature of the present invention and its aspects, will be more readily understood from the following brief description of the accompanying Drawings, and discussion relating thereto.

BRIEF DESCRIPTION OF THE DRAWINGS

Corresponding details on the different Drawing figures have been given the same reference numerals.

DETAILED DESCRIPTION OF PREFERRED EMBODIMENT

Figure 1:
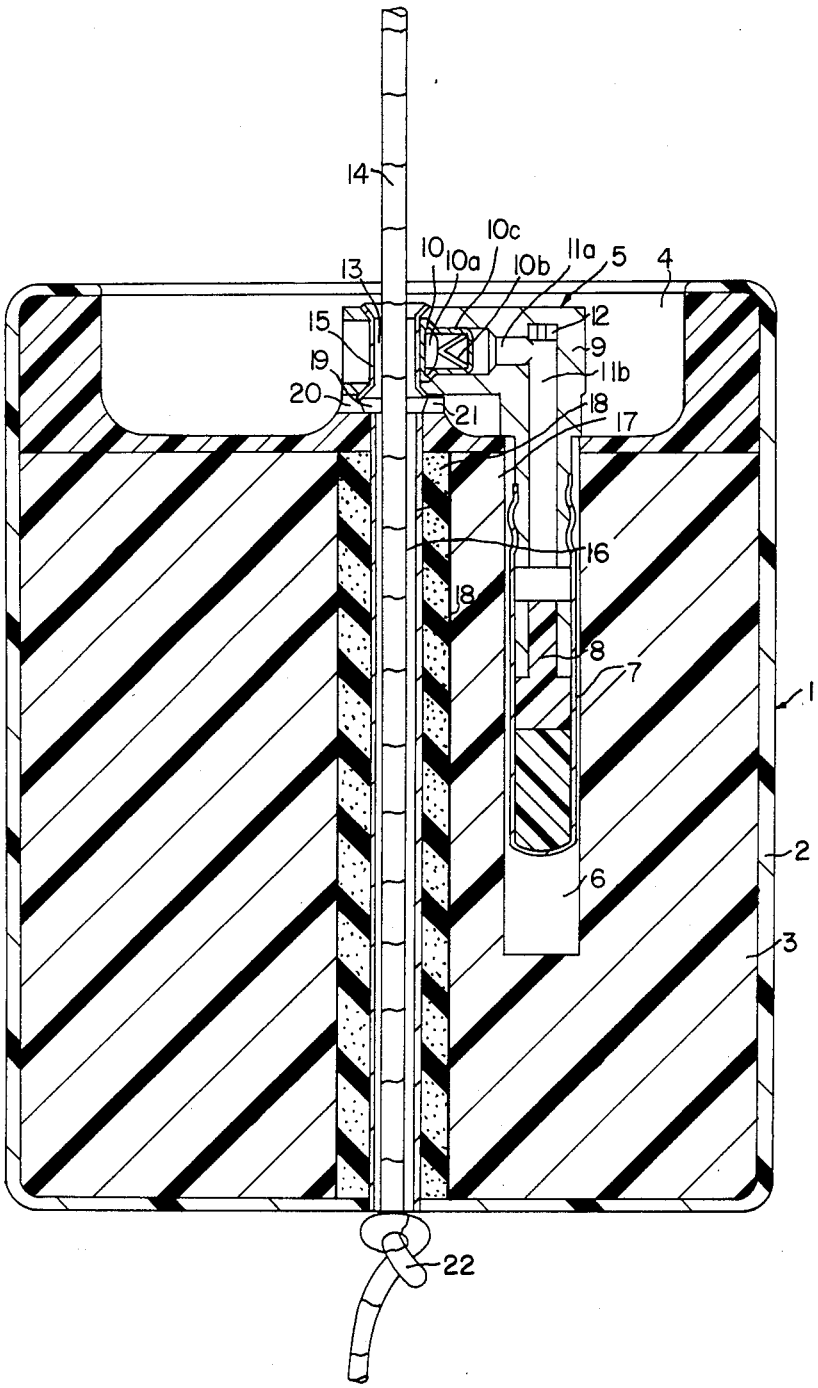
FIGS. 1 and 3 are longitudinal sections through the booster charge of the present invention provided with mounted single- and double-sided detonators, respectively.

Referring to the Drawings, FIG. 1 shows a booster charge 1 consisting of an outer shell 2, a charge 3 of a secondary explosive, for example hexotol or compressed PTB/TMT. At one end of the booster charge, there is a depression or recess 4 for a detonator 5, a coring-out or bore 6 being included in the charge 3 for insertion of the blasting cap 7 of the detonator with its associated pyrotechnical delay assembly 8. The blasting cap 7 and its delay assembly are encased, in a conventional manner, in a thin metal sheath.

The detonator 5 consists moreover of a body 9 of metal or plastic in which the blasting cap 7 is fixedly retained at a right angle to the plane of the body. The body 9 is inserted into the recess 4 and extends past the central passage 16 of the booster charge 1. The detonator body 9 further includes a through-passage 13 for the detonator fuze. When the detonator 5 is mounted in place, the passage 13 and the central channel 16 conicide, such that a detonator fuze 14 may be passed therethrough. From the passage 13, there departs, at right angle to the major direction of the detonator body 9, a first detonator channel 11*a*. At a slight distance from the passage 13, this channel 11*a* forms a right angle with a second detonator channel 11*b* whose other end terminates at the detonation end of the blasting cap 7. At the first end of the channel 11*a*, in immediate association with the passage 13, a percussion cap 10 is pressed in place. This cap 10 comprises an ignition charge 10*a* and a base 10*b*, encased in a metal sheath 10*c*. The passage 13 is lined with a thin tubular rivet 15 which, hence, runs in immediate association with the end of the percussion cap 10 and, on detonation of the fuze 14, is buckled such that the percussion cap is initiated. However, the body 9 and the tubular rivet 15 are dimensioned to be of such strength as not to be pulverised on detonation of the detonation fuze. At the elbow or angle between the first channel 11*a* and the second channel 11*b*, a detonation capsule 12 in the form of a pyrotechnic assembly is disposed so as to ensure that the flame from the percussion cap 10 is transmitted to the delay assembly 8 of the blasting cap 7, which in its turn initiates the blasting cap proper.

The capsule 12 is suitably mounted in the illustrated position in the wall of the first channel 11*a* immediately above the discharge orifice of the second channel 11*b*; where the capsule is protected from being shattered by the detonation flame from the percussion cap 10, but is sufficiently close to be ignited and positioned where its own ignition direction is aimed directly at the delay assembly 8. Furthermore, the capsule 12 is suitably in the form of a compressed cylindrical washer or truncated tube with a center hole which coincides with the opening of the second channel.

With the fuze in the assembled state, the passage 13 constitutes a direct continuation of a channel 16 which passes centrally through the booster 1. The channel 16 is lined with a thin steel tube 17 and may be provided with a lining 18 facing the charge 3 and consisting of, for instance, a deformable plastic material. This is provided to absorb elevated pressure on detonation of the fuze 14 in such cases as, for example, underwater blasting.

In order that the pressure or shock wave deriving from the detonation of the fuze 14 does not force the detonator out of its normal position, a pressure relief gap 19 has been provided between the end of the tube 17 and the detonator body 9. This gap has been provided by means of two beads 20 and 21, disposed in the booster wall about the upper end of the channel 16. These beads could just as well have been incorporated in the detonator body.

Arming of the detonator 5 in the booster 1 is a simple operation, since its blasting cap 7 needs merely be moved down into the coring-out or recess 6, the detonator body 9 be snapped in place in the recess 4 and the detonating fuze 14 be passed through the channel 16 and further through the passage 13 and also be provided with at least one retaining nut on the under face of the booster to prevent it from sliding out of position. In the condition illustrated in FIG. 1, the complete charge is ready to be lowered down, with the fuze 14 as lowering line, into a bore hole where the charge may, for example, be used for initiating a low-energy explosive of the slurry type which otherwise fills out the remainder of the bore hole.

In cases of delay interval, or deck, blasting, use is made of detonators with different pyrotechnical delay assemblies 8 in the detonators in each respective bore hole.

Figure 4:
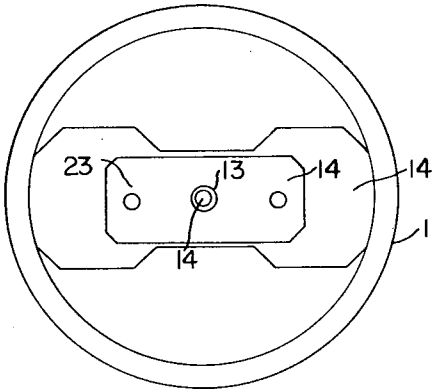
FIG. 4 is an end elevation of the projection in FIG. 3.
Figure 2:
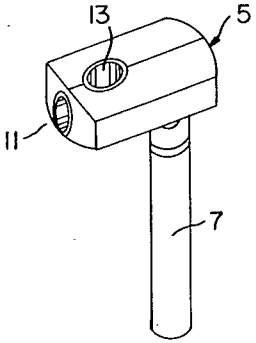
FIG. 2 is an oblique projection of the detonator according to 35 FIG. 1.
Figure 3:
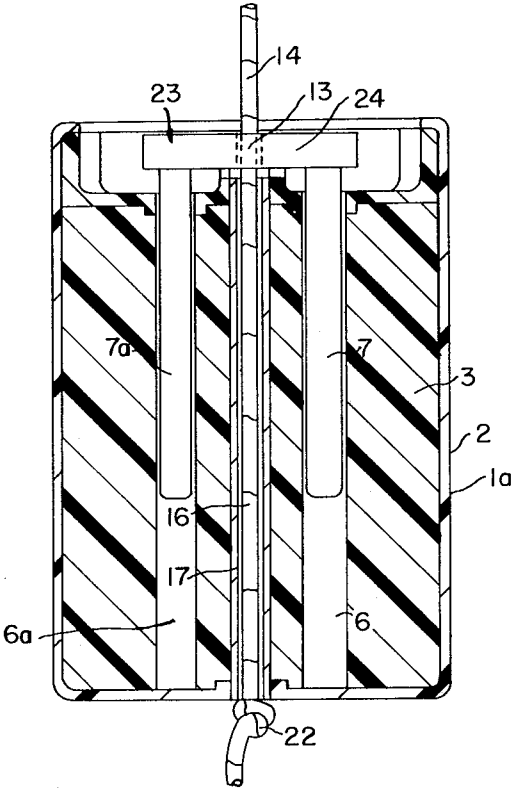

In the apparatus according to the present invention illustrated in FIGS. 3 and 4, there is disclosed a detonator 23 whose detonator body 24 is double-sided, with room for two identical detonation systems. Since all other details are identical, with the exception that the booster 1*a* has been provided with a second coring-out 6a for the second blasting cap 7*a*, all of the remaining details have been given the same reference numerals.

The detonation system permits delayed interval, or deck, blasting in that detonators with different delay assemblies are employed. Naturally, several detonators may be interconnected, either in parallel with the detonating fuze as detonation signal transfer member, or alternatively in series with the charges placed one after the other. Irrespective of the mode selected, initiation of the different detonators will be substantially instantaneous.

What we claim and desire to secure by letters patent is:

1. A detonator for explosive charges to be initiated by a detonating fuze which passes through a passage provided in the body of the detonator, comprising:

a detonating means encapsulated in the body of said detonator in an immediate association with said passage, a blasting cap with an integral delay assembly, anchored in said body of said detonator, in communication with said detonating means, positioned substantially parallel and spaced apart from said passage for the detonating fuze, said detonating means including a percussion cap which is disposed in immediate association with said detonating fuze, and having an impact sensitive detonating charge facing said passage and having detonation direction coinciding with a first detonation channel disposed at right angle to the longitudinal direction of the fuze, said channel merging, through a right-angled elbow, into a second detonation channel which leads to said blasting cap; and a detonation capsule in the form of a pyrotechnical assembly, being disposed in the angle between the first and second detonation channels.

2. The detonator as claimed in claim 1 wherein said detonation capsule is recessed into the wall of said first channel in the angle between said first channel and a discharge opening of said second channel.

3. The detonator as claimed in claim 1, wherein said detonation capsule is a flat cylindrical washer with a center hole; the axis of said center hole coinciding with the center axis of said second channel.

4. The detonator as claimed in claim 1, wherein said percussion cap is provided with a receptive base which rests against its impact-sensitive detonating charge.

5. The detonator as claimed in claim 4, wherein said passage for said detonating fuze is lined with a thin metal insert which separates said percussion cap from the detonating fuze.

6. The detonator as claim in claim 5 wherein said metal insert is in the form of a tubular rivet.

* * * * *